US005758241A

United States Patent [19]

Oyama et al.

[11] Patent Number: 5,758,241

[45] Date of Patent: May 26, 1998

[54] DEVELOPING DEVICE FOR AN IMAGE FORMING APPARATUS

[75] Inventors: Hajime Oyama, Ichikawa; Seiji Oka, Yokohama; Kiyonori Tsuda; Yasushi Akiba, both of Tokyo, all of Japan

[73] Assignee: Ricoh Company, Ltd., Tokyo, Japan

[21] Appl. No.: 769,628

[22] Filed: Dec. 18, 1996

[30] Foreign Application Priority Data

| | | | |
|---|---|---|---|
| Dec. 21, 1995 | [JP] | Japan | 7-349819 |
| Feb. 29, 1996 | [JP] | Japan | 8-071492 |
| Apr. 8, 1996 | [JP] | Japan | 8-111336 |
| Dec. 1, 1996 | [JP] | Japan | 8-336371 |

[51] Int. Cl.[6] ..... G03G 15/08; G03G 15/09

[52] U.S. Cl. ..... 399/272; 399/259; 399/275

[58] Field of Search ..... 399/272, 274, 399/275, 254, 255, 259, 27; 430/122

[56] References Cited

U.S. PATENT DOCUMENTS

| | | | |
|---|---|---|---|
| 4,197,813 | 4/1980 | Yano et al. | 430/122 X |
| 4,406,536 | 9/1983 | Suzuki et al. | 399/259 |
| 4,468,111 | 8/1984 | Yamagata et al. | 389/272 |
| 4,676,192 | 6/1987 | Yuge et al. | 399/259 |
| 4,800,411 | 1/1989 | Tanaka et al. | 399/103 |
| 4,887,131 | 12/1989 | Kinoshita et al. | 399/275 |
| 5,307,126 | 4/1994 | Kurita | 399/272 |

FOREIGN PATENT DOCUMENTS

| | | |
|---|---|---|
| 62-33066 U | 2/1987 | Japan . |
| 63-101958 U | 7/1988 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A developing device for an image forming apparatus and of the type using a developer consisting of toner and magnetic particles is disclosed. While a developing sleeve conveys the developer deposited thereon, toner is automatically replenished to the developer from a toner hopper via an opening formed in the hopper due to the movement of the developer. At the same time, the toner introduced into the developer is charged by friction. A developer storing member includes a penthouse portion. A projection protrudes from the surface of the penthouse portion facing the developing sleeve toward the sleeve and extends in the direction perpendicular to the direction in which the sleeve conveys the developer. The developer forms on the sleeve a layer having stable toner content and stable toner charge without resorting to a sophisticated toner content control mechanism.

25 Claims, 11 Drawing Sheets

DEVELOPING DEVICE FOR AN IMAGE FORMING APPARATUS

BACKGROUND OF THE INVENTION

The present invention relates to a developing device for a copier, facsimile apparatus, printer or similar image forming apparatus and, more particularly, to a developing device of the type for developing a latent image formed on an image carrier with a developer consisting of toner and magnetic particles. More particularly, the present invention is concerned with a developing device of the type suitably replenishing toner to the developer deposited on a developer carrier due to the movement of the developer in accordance with the toner content of the developer while causing the toner in the developer to be charged by friction. With this type of developing device, it is possible to form on the developer carrier a developer layer having stable toner content and stable toner charge without resorting to a sophisticated toner content control mechanism including an agitating member, toner content sensor or the like.

A developing device of the type described is taught in, e.g., Japanese Patent Publication No. 5-67233 (hereinafter "document 1"). The device taught in document 1 includes a casing accommodating a developer carrier. Magnetic particles form a layer on the developer carrier within the casing. A toner replenishing section forms a part of the casing and stores fresh toner such that the toner remains in contact with the layer of the magnetic particles. A stationary magnet is disposed in the developer carrier. While the developer carrier is in rotation, the magnetic particles deposited thereon take in the fresh toner at the toner replenishing section. A developer regulating member regulates the thickness of the mixture of toner and carrier particles being conveyed toward a developing position by the developer carrier. The magnet has a magnetic pole downstream of the toner replenishing section in the direction of rotation of the developer carrier and a magnetic pole upstream of the replenishing section, but lacks a magnetic pole facing the replenishing section. A closure member faces the developer carrier over a range downstream of the toner replenishing section and upstream of the regulating member and in which the magnetic fields of the magnetic poles act. The closure member and developer carrier form therebetween a developer storing space filled with a layer of magnetic particles.

In the above configuration of document 1, when the toner content and, therefore, the volume of the developer staying in the developer storing space increases, the packing ratio of the developer increases and slows down the movement of the developer. As a result, the developer in the developer storing space moves little, except for the developer passing the regulating member. Conversely, when the toner content and volume of the developer decrease due to repeated development, the packing ratio decreases and allows the developer to move easily. Consequently, the developer takes in the fresh toner. This increases the toner content and volume of the developer until the the movement of the developer has been slowed down, as stated above. As a result, the replenishment of the toner to the developer is interrupted. In this manner, the toner is automatically replenished due to the movement of the developer staying in the space. The toner content is, therefore, automatically controlled without resorting to a toner content sensor.

Assume that the developing device of the type described is removed from the image forming apparatus and set in the opposite position. Then, the condition in which the toner is replenished to the developer due to the movement of the developer varies. This sometimes brings about, e.g., strip-like blurring (background contamination) and an irregular density distribution perpendicular to the direction in which the developer carrier conveys the developer. Japanese Patent Laid-Open Publication No. 63-4282 (hereinafter "document 2"), for example, discloses a developing device as a solution to the above problem. The device of document 2 includes a first and a second member for regulating the replenishment of fresh toner. The first toner regulating member has its one end affixed at a position above a doctor blade or developer regulating member, and extends into a toner hopper or toner storing section. The second toner regulating member is positioned closer to the toner hopper than the first toner regulating member and separates a developer storing space and toner hopper from the upper portion of the developing device. The lower—or free—end of the second regulating member is positioned on the imaginary extension of the free end of the first regulating member or at the developer carrier side.

In the device of document 2, the portion of the developer forming the uppermost layer on the developer carrier has lower density than the other portion and takes in the toner more easily. This portion of the developer tends to move to a regulating position assigned to the doctor blade with a higher toner content than the other portion close to the surface of the developer carrier. However, before such a portion of the developer enters a thickness regulating region defined by the first toner regulating member, the surface of the developer carrier, and the doctor blade, the second toner regulating member blocks the above portion with its free end. As a result, the developer with an excessively high toner content is prevented from reaching the thickness regulating region.

This allows only the toner sufficiently charged by friction to arrive at a developing position.

More specifically, in document 2, the device is implemented as a unit including a start developer chamber formed at one side of the developer storing space. Presumably, the unit storing a start developer in its start developer chamber is, e.g., shaken horizontally in order to distribute the developer evenly in the axial direction of the developing sleeve. Then, a closure member, for example, separating the start developer chamber and the developer storing space adjoining the sleeve is removed so as to introduce the start developer into the developer storing space. As a result, the developer in the space is distributed evenly in the axial direction of the sleeve. A wall partitioning the start developer chamber and toner storing section has its lower end extends toward the surface of the sleeve, so that the lower end of the extension forms the second toner regulating member. Because the second toner regulating member is implemented by a part of the wall delimiting the start developer chamber, the path for the toner to be transferred from the toner storing section to the developer deposited on the sleeve is relatively long, i.e., it consists of a path portion below the developer storing section and a path portion below the start developer chamber. In light of this, toner feeding means are provided on the above path in addition to main toner feeding means disposed in the toner storing section.

Japanese Patent Laid-Open Publication No. 7-119339 (hereinafter "document 3") proposes a developing device including a developer carrier accommodating magnetic field generating means therein. The developer carrier magnetically retains a developer of the kind described thereon and conveys it to a developing position where it faces an image carrier, thereby developing a latent image formed on the image carrier. A developer regulating member regulates the amount of the developer to be conveyed to the developing position by the developer carrier. A developer storing member faces the surface of the developer carrier at a predetermined distance. This member cooperates with the developer carrier to form a toner storing space in which the developer blocked by the regulating member stays. A toner storing section adjoins the above space from the upstream side with respect to the direction in which the developer carrier conveys the developer. An opening is formed in the toner storing section and faces the developer carrier. The toner storing space allows, in a condition wherein the toner replenished via the opening reaches its upper limit, a developer layer formed above an interface formed in the first space to move in the opposite direction to the developer layer existing on the developer carrier. With this configuration, it is possible to promote sure mixture and agitation of the developer in the above space.

The conventional developing devices described above have the following problems left unsolved. The device of document 2 is not practicable without resorting to two toner regulating members, failing to achieve cost- and space-saving construction. Further, in the device of the type taught in document 2, when the toner is stored in the toner storing section in a great amount, it is likely that, due to the weight of the toner itself, the replenishment of the toner to the developer becomes unstable, and the mixture and agitation of the developer becomes inactive in the space contacting the toner present in the toner storing section. As a result, irregular image density and blurring (background contamination) are apt to occur due to irregular development.

As for document 3, experiments showed that gravity acting on the toner present in the toner storing section and the magnetic force acting even on the developer staying in the developer storing space bring about various problems, as follows. Gravity acting on the toner in the toner storing section acts on the developer in the above space via the opening for replenishment. Therefore, when the amount of toner remaining in the toner storing section varies, the force of gravity affects the developer staying in the space. For example, when the toner remains in the toner storing section in a great amount, more of it is introduced into the space than necessary with the result that the developer in the space is compressed. This increases a load acting on drive means for driving the developer carrier, thereby producing noise and stopping the machine due to the detection of unusual torque. Regarding the magnetic force, assume that magnetic field generating means is disposed in the developer carrier, and that use is made of magnetic toner. Then, the magnetic force of the magnetic field generating means acts on the toner present in the toner storing section. In this condition, it is likely that the toner is attracted toward the developer carrier and causes the developer to be compressed in the developer storing space. This also increases the load acting on the drive means for driving the developer carrier and brings about the above troubles.

Moreover, the problem with the developing device of the type described is that the toner content of the developer is apt to be irregular in the direction perpendicular to the direction in which the developer conveys the developer.

Technologies relating to the present invention are also taught in Japanese Utility Model Laid-Open Publication Nos. 62-33066 and 63-101958.

SUMMARY OF THE INVENTION

It is, therefore, an object of the present invention to provide a developing device of the type described and capable of mixing and agitating a developer staying in a developer storing space sufficiently without resorting to a plurality of toner regulating means, thereby freeing images from background contamination, irregular density and other defects.

It is another object of the present invention to provide a developing device of the type described and capable of promoting stable replenishment of toner to a developer and the stable charging of the toner in the developer even when a great amount of toner exists in a toner storing section.

It is still another object of the present invention to provide a developing device of the type described and capable of promoting the agitation of a developer and obviating excessive torque ascribable to the compression of the developer in a developer storing space.

It is yet another object of the present invention to provide a developing device of the type described and capable of obviating irregular toner density in the direction perpendicular to the direction in which a developer carrier conveys a developer.

In accordance with the present invention, a developing device includes a developer carrier for conveying a developer deposited thereon and containing toner and magnetic particles. A magnetic field generating body is disposed in the developer carrier for generating a magnetic field for depositing the developer on the developer carrier. A developer regulating member regulates the amount of the developer deposited on the developer carrier. A developer storing member forms a developer storing space adjoining the developer regulating member from the upstream side with respect to the direction of conveyance in which the developer carrier conveys the developer. A toner storing section adjoins the developer storing space from the upstream side in the direction of conveyance, and has an opening for toner replenishment facing the developer carrier. Fresh toner is replenished from the toner storing section to the developer via the opening due to the movement of the developer. A projection protrudes from the surface of the developer storing member facing the developer carrier toward the developer carrier, and extends in the direction perpendicular to the direction of conveyance.

Also, in accordance with the present invention, a developing device of the type including the above developer carrier, magnetic field generating body, developer regulating member, developer storing member, and toner storing section further includes a toner bearing member disposed in the toner storing section in the vicinity of the opening. The toner bearing member bears the weight of the toner at a level lower than a toner level in the toner storing section.

Further, in accordance with the present invention, in a developing device of the type including the above developer carrier, magnetic field generating body, developer regulating member, developer storing member, and toner storing section, the developer storing space includes a partition member separating the developer storing space into a first space facing the opening and located at the upstream side with respect to the direction of conveyance, and a second space located at the downstream side with respect to the direction of conveyance. The partition member protrudes from the surface of a wall of the developer storing member facing the developer carrier toward the developer carrier, extends in the direction perpendicular to the direction of conveyance, and faces the surface of the developer carrier at the end of the partition member at a preselected distance, regulating the powder pressure of the developer acting on the second space from the first space.

Moreover, in accordance with the present invention, a developing device includes a developer carrier for conveying a developer deposited thereon and containing toner and magnetic particles. A magnetic field generating body is disposed in the developer carrier for generating a magnetic field for depositing the developer on the developer carrier. A first developer regulating member regulates the amount of the developer deposited on the developer carrier. A developer storing space is surrounded by a cover member and the surface of the developer carrier for allowing the developer blocked by the first developer regulating member to stay in the developer storing space. A toner storing section adjoins the developer storing space from the upstream side in the direction of conveyance, and has an opening for toner replenishment facing the developer carrier. Fresh toner is replenished from the toner storing section to the developer via the opening due to the movement of the developer. A second developer regulating member faces, in the direction normal to the surface of the developer carrier, a point of the surface of the developer carrier between two adjacent ones of the magnetic poles upstream of the first developer regulating member in the direction of conveyance and where a magnetic force in the direction normal to the surface of the developer carrier is minimum, thereby regulating the replenishment of the toner.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 19:
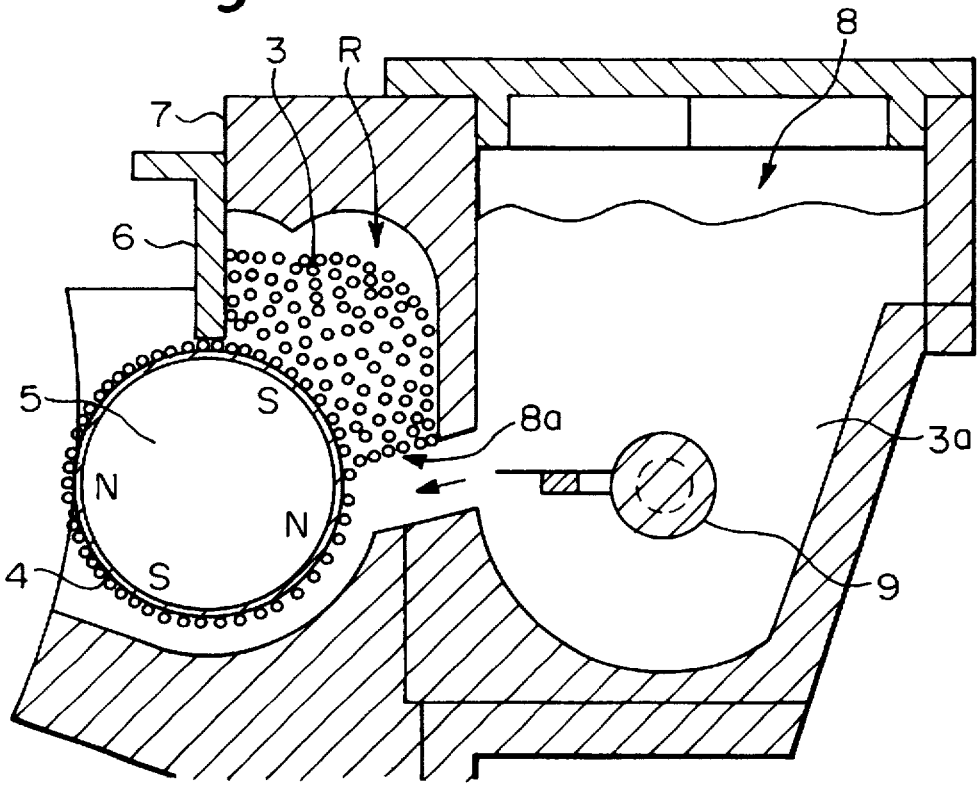
Fig. 19 PRIOR ART
FIG. 19 is a front view of a conventional developing device having an automatic toner content control capability.

To better understand the present invention, a brief reference will be made to a conventional developing device, shown in FIG. 19. As shown, the device includes a developer storing space R formed by a wall which may be implemented by a developer storing member 7. A gap between the lower end of the developer storing member 7 and a developing sleeve 4 plays the role of an opening 8*a* for toner replenishment. Toner 3*a* is stored in a toner storing section 8. The toner 3*a* is introduced into the developer storing space R via the opening 8*a* due to the movement of a developer 3 existing in the space R. The problem with this type of device is that the toner content of the developer is irregular. This presumably stems from the fact that the toner is introduced into the space R in an irregular amount in the axial direction of the sleeve 4. We conducted reseach and a series of experiments based on the above presumption and found the following.

The magnetic force of a magnetic pole provided on the sleeve 4 is not uniform in the axial direction of the sleeve 4. As a result, the developer in the space R collects densely at portions where the magnetic force is strong in the above direction, but collects little at the other portions. Such an irregular density distribution of the developer occurring in the space R in the above direction renders the movement of the developer irregular. The toner is, therefore, easily introduced into the space R at the portions where the developer density is low, but not at the other portions where the developer density is high.

Figure 20:
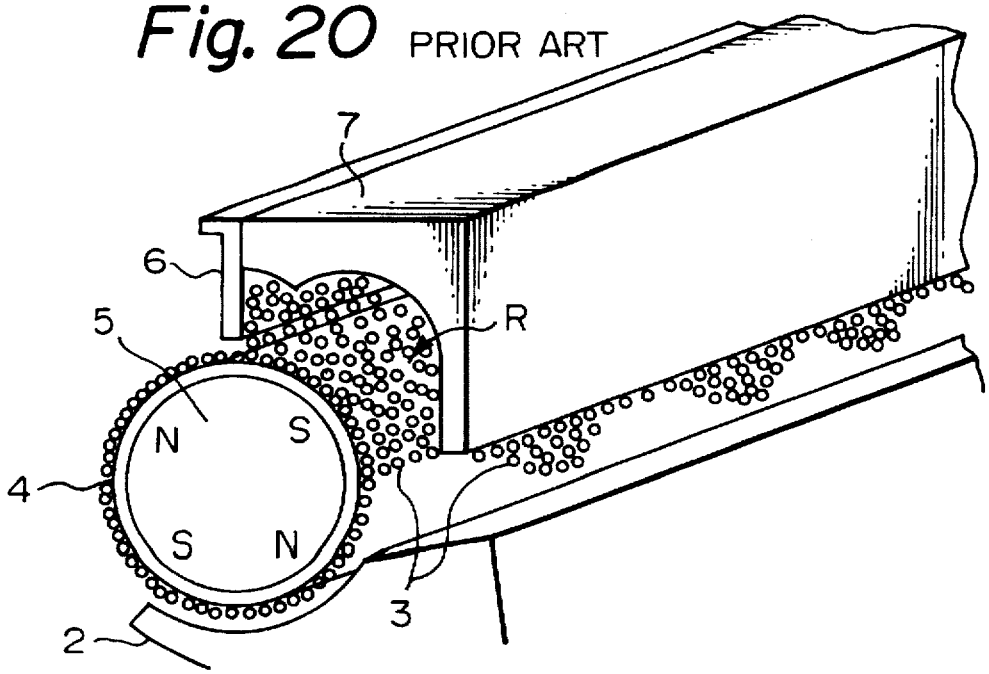
Fig. 20 PRIOR ART
FIG. 20 is a view useful for understanding a problem with the developing device shown in FIG. 19.

Presumably, another cause of the irregular toner replenishment is the positional relation between the natural shape of the developer deposited on the sleeve 4 by, e.g., four magnetic poles provided within the sleeve 4 and the developer storing member 7 adjoining the sleeve 4. Specifically, assume that the developer 3 is deposited on the sleeve 4 in its natural shape by the magnetic poles, and that the member 7 is so configured as to press toward the sleeve 4 the portion of the developer 3 protruding toward the toner storing section 8. Then, no surplus portion is available in the space R. As a result, as shown in FIG. 20, the developer density locally increases in the axial direction of the sleeve 4 to such a degree that the developer 3 overflows the space R downward below the opening 8*a*. The developer 3 overflown the space R obstructs the replenishment of the toner 3*a*. Consequently, the toner content of the developer 3 cannot be accurately controlled in accordance with the toner content in the space R, resulting in irregular image density.

A first solution to the above problem is to eliminate the irregular magnetic force distribution in the axial direction of the sleeve 4. A second solution is to locate the member 7 at a position where a broad space R is available, so that the developer 3 can move to take in a sufficient amount of toner even at the portions where the density is high. However, the first solution is impractical or increases, if not impractical, the production cost. The second solution brings about a problem that the toner is replenished in an excessive amount and flies about at the portions where the developer density is low. Moreover, even with the second solution, it is impossible to obviate the irregular toner replenishing ability itself ascribable to the irregular developer density.

The second toner regulating member taught in the previously referenced document 2 may reduce the irregular toner content of the developer to a certain degree in the direction perpendicular to the direction of developer conveyance, i.e., in the axial direction of the sleeve 4. However, there is a fear that the irregular toner content cannot be sufficiently obviated, depending on the position where the free end of the above regulating member faces the sleeve.

Preferred embodiments of the developing device in accordance with the present invention will be described hereinafter. The illustrative embodiments are applied to an electrophotographic copier by way of example. It is to be noted that the same or similar structural elements are designated by identical Reference numerals.

1st Embodiment

Figure 1A:
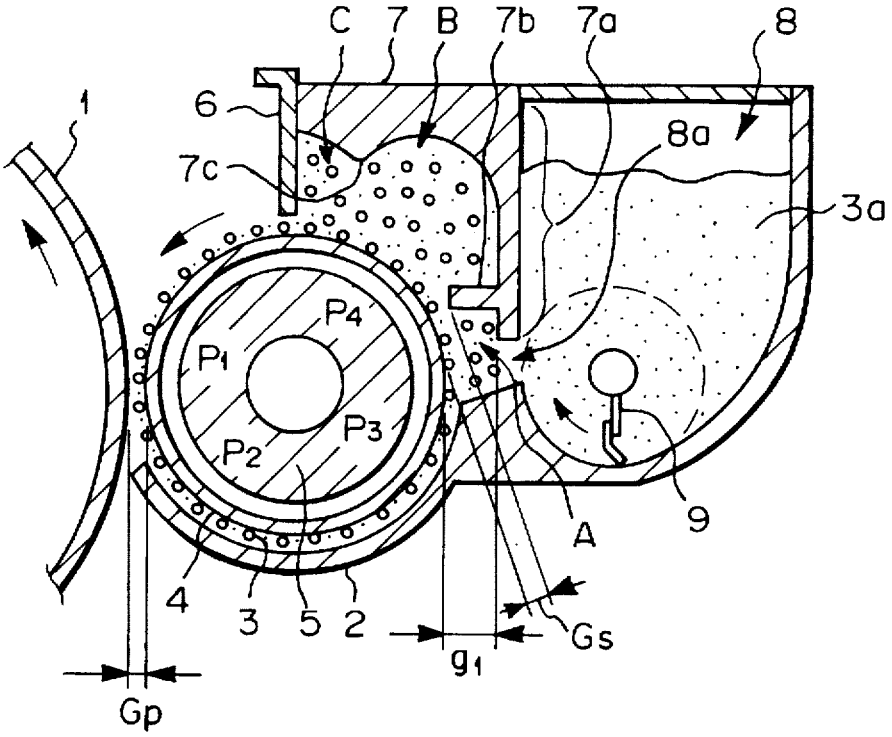
FIG. 1A is a front view showing a first embodiment of the developing device in accordance with the present invention.

Referring to FIG. 1A, a developing device embodying the present invention is located at one side of a photoconductive element implemented as a drum 1. The developing device includes a casing 2 having an opening facing the drum 1. A developing sleeve or developer carrier 4 is formed of a nonmagnetic material and partly exposed to the outside via the opening of the casing 2. A developer 3 which is a mixture of toner particles and magnetic particles is deposited on the surface of the sleeve 4. A stationary magnet roller or magnetic field generating means 5 is disposed in the sleeve 4 and has magnetic poles P1–P4, as illustrated. A doctor or developer regulating means 6 regulates the amount of the developer 3 being conveyed by the sleeve 4. A developer storing member 7 forms a developer storing space adjoining the doctor 6 from the upstream side with respect to the direction in which the sleeve 4 conveys the developer 3. Let this direction be referred to as a direction of conveyance. A toner hopper or toner storing section 8 stores fresh toner 3 a therein. The pole P1 is a main pole for development. The poles P2 and P3 are poles for conveyance while the pole P4 is a pole for conveyance and agitation. The poles P1–P4 should preferably be magnetized to N and S polarities alternately.

Specifically, the doctor 6 is affixed to the end of the developer storing member 7 adjacent to the drum 1. The member 7 includes a free end portion or penthouse, 7*a* extending toward an opening 8*a*, which will be described later. The penthouse 7*a* forms a part of the toner hopper 8 at the same time. The space formed between the member 7, inclusive of the doctor 6, and the sleeve 4 accommodates a part of the developer 3 shaved off by the doctor 6 during conveyance toward a developing position where the sleeve 4 faces the drum 1. The portion of the casing 2 located at the right-hand side of the sleeve 4 cooperates with the penthouse 7*a* to form the toner hopper 8 storing the fresh toner 3*a*. The toner hopper 8 adjoins the above space from the upstream side in the direction of conveyance. The opening 8*a* is delimited by the inner periphery of the casing 2 and the lower end of the penthouse 7*a*. The fresh toner 3*a* is replenished from the toner hopper 8 via the opening 8*a*, as will be described in detail later.

An agitator or agitating member 9 is positioned in the toner hopper 8 in the vicinity of the opening 8*a*. The agitator 9 feeds the toner 3*a* toward the opening 8*a* while agitating it. Preferably, the agitator 9 is rotated in an interlocked fashion with respect to the sleeve 4. A 100 μm to 200 μm thick PET (polyethylene terephthalate) film should preferably be fitted on the edge of the agitator 9. Such a film will obviate excessive loads when the agitator 9 adjoins or contacts the inner periphery of the toner hopper 8.

In the illustrative embodiment, a projection 7*b* protrudes from the surface of the penthouse 7*a* facing the sleeve 4 toward the sleeve 4. The projection 7*b* is elongate in the direction perpendicular to the direction of conveyance, i.e., in the axial direction of the sleeve 4. The projection 7*b* divides the developer storing space into a first or upstream space A and a second or downstream space B. The developer is mixed and agitated in each of the two spaces A and B.

Another projection 7*c* convex toward the sleeve 4 protrudes from the inner periphery of the developer storing member 7 toward a position slightly downstream of the pole P4 of the magnet roller 5 with respect to the direction of conveyance. In a portion C of the space surrounded by the projection 7*c*, doctor 6 and sleeve 4, the developer 3 moves little, except for the developer to be passed through a doctor gap between the doctor 6 and the sleeve 4. The projection 7*c* may be omitted, if desired.

The projection 7*b* faces the portion of the magnet roller between the conveyance pole P3 and the conveyance/agitation pole P4 and where the magnetic force attracting the developer 3 toward the surface of the sleeve 4 is comparatively weak. This allows the projection 7*b* to block the developer 3 more easily than when it adjoins the pole P3 or P4. Consequently, the developer 3 is allowed to flow in a more desirable manner for the mixture and agitation thereof in the first space A.

Figure 2:
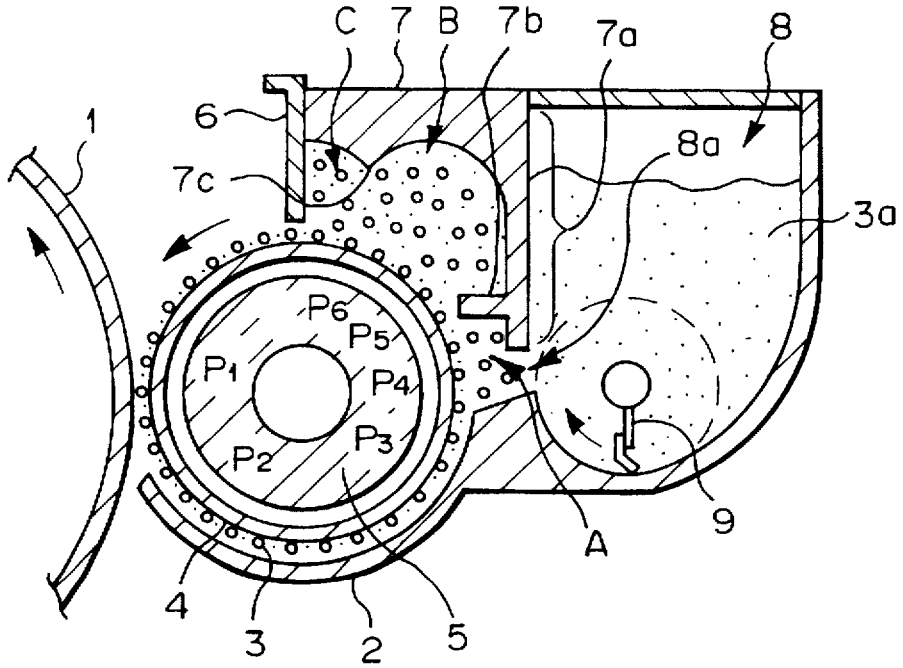
FIG. 2 is a front view of a magnet roller representative of a modification of the first embodiment.

Alternatively, as shown in FIG. 2, the magnet roller 5 may have six poles P1–P6 three of which face the developer storing space. Again, the poles P1–P6 should preferably be magnetized to N and S polarities alternately. For example, the poles P1, P3 and P5 are N poles while the poles P2, P4 and P6 are S poles. In the configuration shown in FIG. 2, the projection 7*b* should preferably face the portion of the magnet roller 5 between the poles P4 and P5.

In the illustrative embodiment shown in FIG. 1A, a gap Gs between the end of the projection 7*b* and the surface of the sleeve 4 is selected to be smaller than a gap g1 between the free end of the penthouse 7*a* and the surface of the sleeve 4. For example, if the gap g1 is 5 mm to 10 mm, then the gap Gs should preferably be 1 mm to 4 mm. In this condition, the developer taken in the toner 3*a* from the hopper 8 via the opening 8*a* and passed through the gap g1 is caused to pass through the gap Gs smaller than the gap g1. As a result, the projection 7*b* surely blocks a part of the developer 3 moved from the opening 8*a*. This sets up the more desirable flow of the developer 3, as stated earlier.

Should the gap Gs be excessively small, it would block the developer 3 being conveyed by the sleeve 4 more than necessary. It is therefore preferable that the gap Gs be equal to or larger than a gap Gp between the drum 1 and the sleeve 4, i.e., 2× Gp or above. For example, if the gap Gp is 0.5 mm, then the gap Gs should preferably be 1 mm or greater.

Figure 1B:
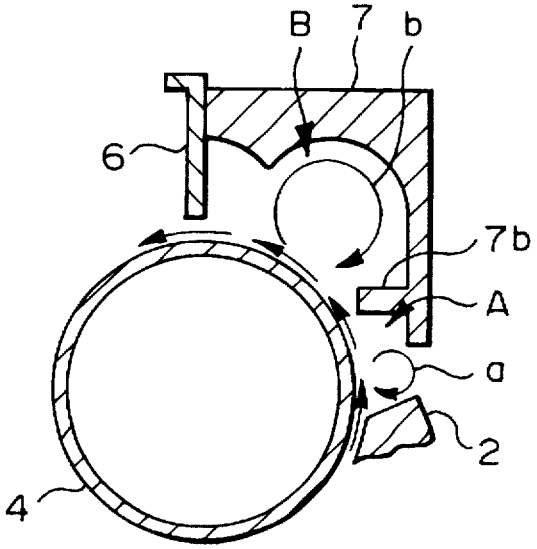
FIG. 1B demonstrates the movement of a developer to occur in the first embodiment.

In operation, the agitator 9 rotating in the direction indicated by an arrow in FIG. 1A drives the toner toward the opening 8*a* while agitating it. The toner 3*a* is replenished into the developer 3 via the opening 8*a* on the basis of the movement of the developer 3. The sleeve 4 conveys the developer 3 taken in the toner 3*a* toward the projection 7*b*. Before the developer 3 reaches the projection 7*b*, the toner 3*a* is mixed with the developer 3 and agitated preliminarily in the first space A due to the first movement of the developer 3 (indicated by an arrow a in FIG. 1B). At this instant, the developer 3 has a toner content TA higher than the toner content TB of the developer 3 existing in the second space B.

The developer 3 mixed and agitated in the first space A is partly conveyed by the sleeve 4 into the second space B via the gap between the projection 7*b* and the sleeve 4. In the second space B, the toner is again mixed with the developer and agitated due to the second movement of the developer (indicated by an arrow b in FIG. 1B).

As stated above, in the illustrative embodiment, the toner of the developer deposited on the sleeve 4 is charged a plurality of times by mixing and agitating of the developer occurring in the first and second spaces A and B. This successfully reduces the probability that toner particles of small charge reach the developing position past the doctor 6, compared to the conventional configuration in which the mixture and agitation occur only once. Further, when the toner content of the developer is irregular in the axial direction of the sleeve 4, the mixture and agitation of the developer including the oblique movement of the developer from high content portions to low content portions occur a plurality of times. This makes uniform the amount of charge deposited on the toner and the toner content in the axial direction of the sleeve 4, compared to the above conventional configuration. As a result, the embodiment insures images suffering from a minimum of background contamination and irregular density.

Toner particles of small charge can be prevented from reaching the developing position only if a single projection 7*b* is formed on the surface of the developer storing member 7 facing the sleeve 7. This eliminates the need for a plurality of regulating members and thereby saves cost and space.

Figure 3:
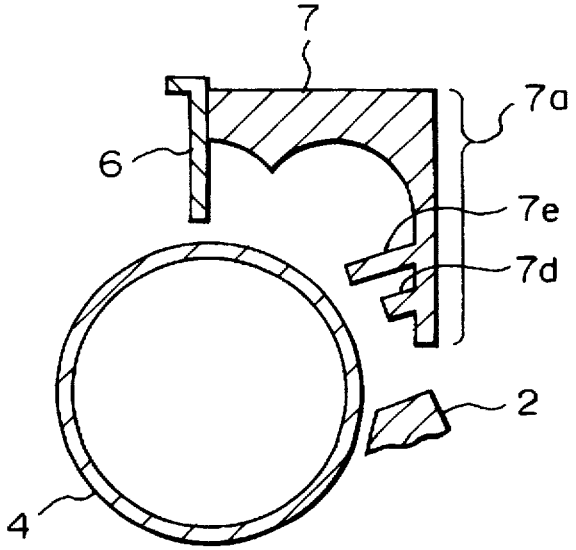
FIG. 3 is a front view of a penthouse representative of another modification of the first embodiment.

As shown in FIG. 3, two projections 7*d* and 7*e* may be formed on the penthouse 7*a* in addition to the above projection 7*b*, if desired. With this configuration, it is possible to form three consecutive spaces for mixture and agitation. The three spaces will further enhance the mixing and agitating function and will further reduce defective images.

Figure 4A:
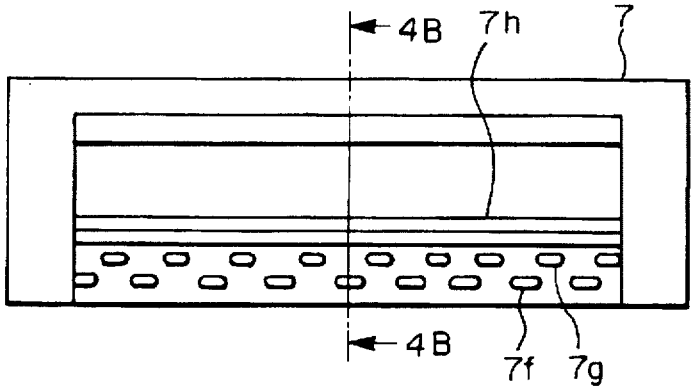
FIG. 4A is a side elevation of a penthouse representative of still another modification of the first embodiment.
Figure 4B:
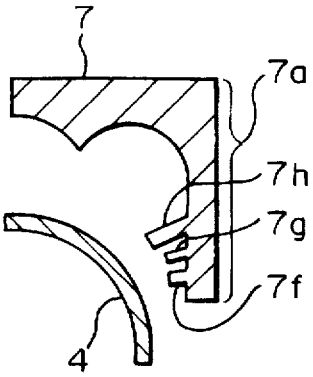
FIG. 4B is a section along line DD–DD' of FIG. 4A.

Further, as shown in FIGS. 4A and 4B, a plurality of projections (three in this case ) 7*f*, 7*g* and 7*h* may be sequentially formed on the penthouse 7*a* in the direction of conveyance, i.e., in the direction of rotation of the sleeve 4. In this specific configuration, the projections 7*f* and 7*g* positioned at the upstream side in the above direction are each divided in the axial direction of the sleeve 4, as illustrated. The projection 7*h* located at the downstream side is spaced from the sleeve 4 by a substantially constant distance in the axial direction of the sleeve 4. The projections 7*f* and 7*g* may each be divided either regularly or irregularly in the axial direction of the sleeve 4. The developer blocked by the divided projections 7*f* and 7*g* moves in the axial direction of the sleeve 4 and passes through the voids of the projections 7*f* and 7*g*. As a result, the mixing and agitating function is enhanced in the axial direction of the sleeve 4. Moreover, the gap between the downstream projection 7*h* and the sleeve 4 is substantially constant in the axial direction of the sleeve 4. Therefore, the developer desirably mixed and agitated by the projections 7*f* and 7*g* can pass the projection 7*h* in a uniform amount in the axial direction of the sleeve 4.

2nd Embodiment

Figure 5:
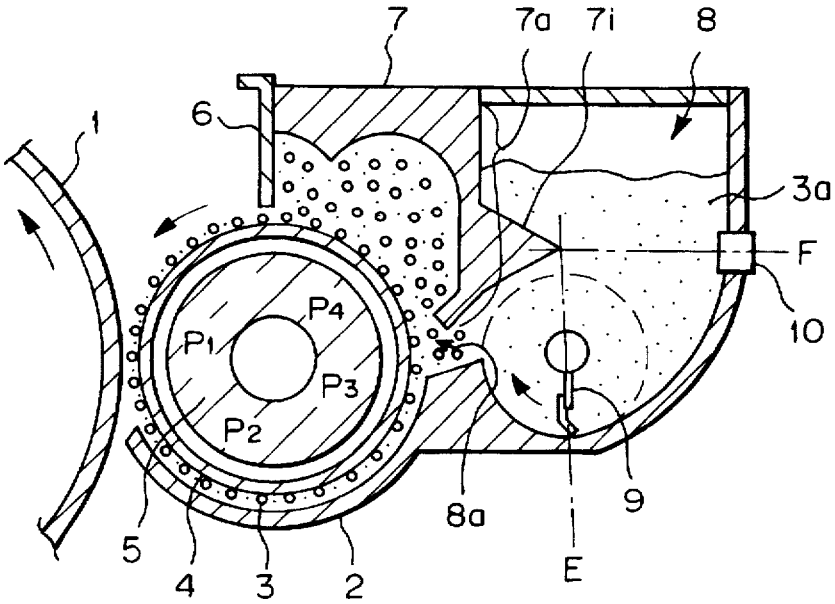
FIG. 5 is a front view showing a second embodiment of the present invention.

FIG. 5 shows a second embodiment of the present invention which is essentially similar to the first embodiment except for the following. Briefly, although the developer storing member 7 does not have any of the projections 7*b* and 7*d*–7*h*, this embodiment stabilizes the influence of the powder pressure of the toner hopper 8 on the mixture and agitation occurring in the developer storing space, i.e., stabilizes the mixture and agitation of the developer with the just taken in fresh toner.

In a conventional developing device of the type taking in the toner from the toner hopper 8 on the basis of the movement of the developer, the influence of weighting ascribable to the weight of the toner in the hopper 8 and acting on the developer existing in the developer storing space varies in accordance with the amount of toner remaining in the hopper 8. When the hopper 8 is full of the toner, the influence of weighting is great and renders the mixture and agitation in the developer storing space inactive. This is apt to produce a defective toner image having irregular density or contaminated background. As the amount of the toner remaining in the hopper 8 sequentially decreases due to repeated development, the mixture and agitation in the developer storing space becomes active and reduces defective toner images.

In light of the above, as shown in FIG. 5, a toner bearing member 7*i* is formed on the surface of the penthouse 7*a* forming a part of the toner hopper 8. The toner bearing member 7*i* sustains the weight of the toner 3*a* existing above a toner replenishing path adjoining the opening 8*a*. Assume that the agitator 9 rotatable in the direction indicated by an arrow in FIG. 5 is positioned on the above path adjoining the opening 8*a*, as illustrated. Then, the toner bearing member 7*i* should preferably extend from the penthouse 7*a* to a position above the center of rotation of the agitator 9 in the perpendicular direction E. Also, the face of the member 7*i* facing the agitator 9 should preferably be shaped complementarily to the locus along which the edge of the agitator 9 moves. While the member 7*i* is molded integrally with the penthouse 7*a*, it may be replaced with a member separate from and affixed to the penthouse 7*a*.

In this embodiment, the toner bearing member 7*i* sustains the toner existing above the toner replenishing path adjoining the opening 8*a*. The member 7*i* therefore causes the weight of the toner 3*a* to act little on the developer existing in the developer storing space adjoining the opening 8*a*. Consequently, the mixture and agitation in the developer storing space is stabilized without regard to the amount of the toner remaining in the toner hopper 8.

In FIG. 5, a toner end sensor or toner end sensing means 10 is included in the toner hopper 8. If the toner end sensing level F of the sensor 10 is higher than the highest point of the locus of the edge of the agitator 9, as illustrated, then the level where the toner bearing member 7*i* bears the toner should preferably be lower than the level F. This insures the stable mixture and agitation of the developer in the toner storing space until the hopper 8 reaches a toner end condition, i.e., until the toner level in the hopper 8 falls to the toner end sensing level F.

3rd Embodiment

Figure 6:
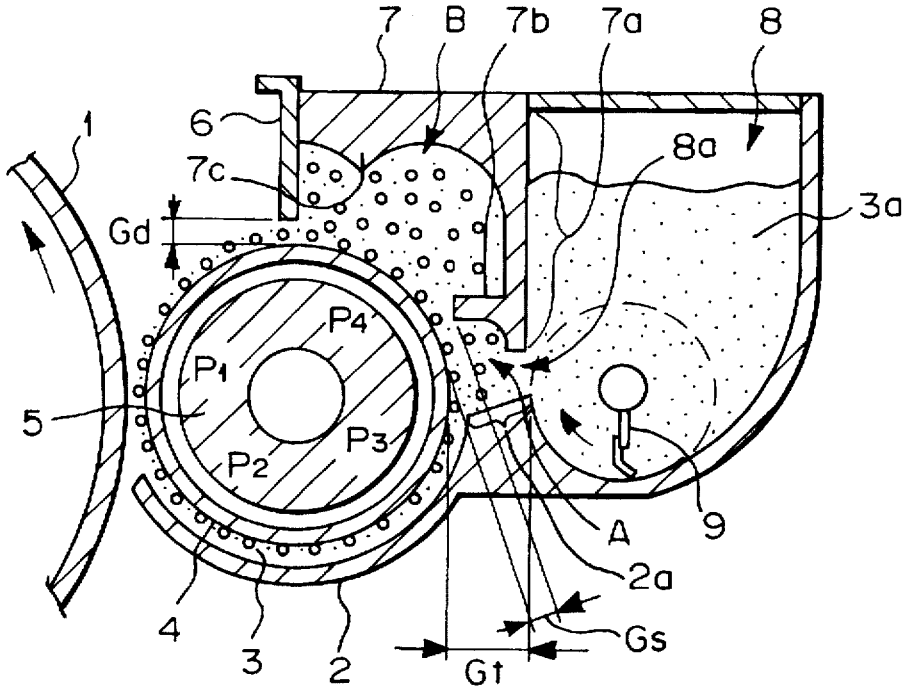
FIG. 6 is a front view showing a third embodiment of the present invention.

Referring to FIG. 6, a third embodiment of the present invention will be described which is also similar to the first embodiment except for the following. This embodiment is characterized in that the projection 7*c* is so configured as to regulate the powder pressure of the developer existing in the first space A and acting on the second space B. Specifically, so long as the developer is agitated in the second space B of the first embodiment also, the gap Gs between the projection 7*b* and the sleeve 4 may be relatively great. However, in this embodiment, the gap Gs is relative small in order to regulate the powder pressure acting on the second space B from the first space A.

For example, a gap Gd between the doctor 6 and the sleeve 4 is selected to be 0.3 mm to 0.5 mm while the gap Gs between the projection 7b and the sleeve 4 is selected to be 1.0 mm to 1.5 mm.

Figure 7:
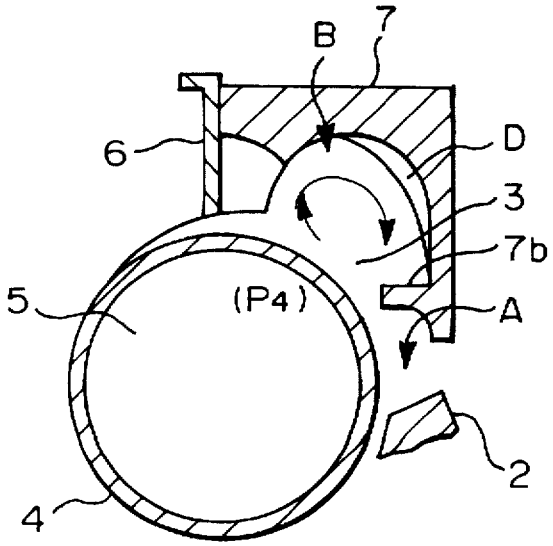
FIG. 7 shows the movement of the developer to occur in a first and a second space particular to the third embodiment.

FIG. 7 shows the condition of the developer existing in the first space A and that of the developer existing in the second space B. As shown, the toner is fed from the toner hopper 8, not shown, to the space A in a great amount due to gravity acting on the toner, so that the space A is filled with the developer and, therefore, is weighted. On the other hand, in the space B separated from the space A by the projection 7b, the powder pressure acting on the developer in the space A does not act. In addition, the developer in the space B has its weight received by the projection 7b.

The packing ratio of the developer in the above space B is dependent on the powder pressure acting on the developer from the space A and the magnetic force of the pole P4 facing the space B. That is, as the powder pressure acting on the developer in the space B decreases, the developer fills the space B in a lesser amount. Also, the amount of the developer to fill the space B decreases with a decrease in the magnetic force of the pole P4. In such conditions, the developer moves easily.

Figure 8:
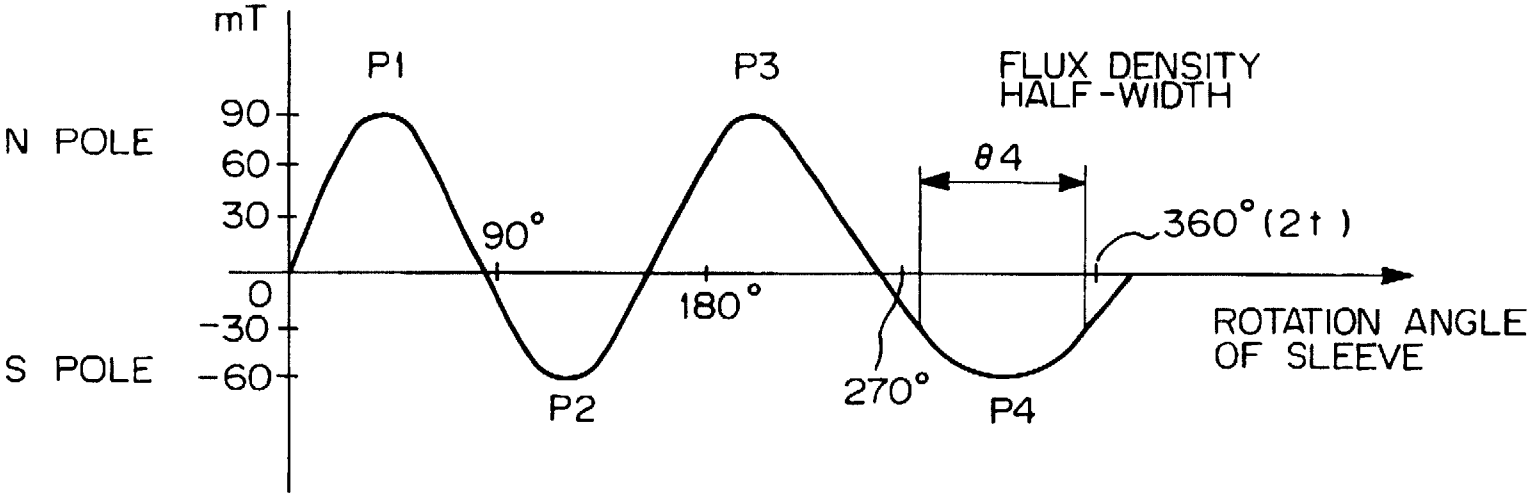
Fig. 8 PRIOR ART
FIG. 8 is a graph showing the flux density half-width of a magnetic pole P4 included in a conventional magnet roller.

FIG. 8 is a graph showing the flux densities of the poles P1–P4. In FIG. 8, the ordinate indicates the flux densities while the abscissa indicates the angle of rotation of the sleeve 4. As shown, the pole P4 has a flux density half-width (angle) θ greater than 60° inclusive which is not particularly small. Therefore, the flux density of the pole P4, as measured on the sleeve 4, has its peak value selected to be relatively small beforehand. Specifically, in the illustrative embodiment, the peak value of the flux density of the pole P4 on the sleeve 4 is selected between 50 mT and 70 mT, i.e., 500 Gauss and 700 Gauss. It is to be noted that when the flux density half-width (angle) θ4 is about 30°, the developer will not fill the second space B in an excessive amount even if the peak value is 90 mT. Stated another way, by reducing the range over which the magnetic force acts on the space B, it is possible to prevent the developer from filling the space B in an excessive amount.

In operation, the agitator 9 rotating in the direction shown in FIG. 6 drives the toner 3a toward the opening 8a while agitating it. The toner 3a is replenished into the first space A via the opening 8a in accordance with the movement of the developer 3. In the first space A, the weight of the toner 3a existing in the toner hopper 8 directly acts on the developer 3. The projection 7b prevents the weight of the developer in the first space A from acting on the the second space B. The toner and carrier existing in the space A are mixed together at the end of the projection 7b and then transferred to the space B via the gap Gs between the projection 7b and the sleeve 4.

The gap Gs between the projection 7b and the sleeve 4 is as small as 1.0 mm to 1.5 mm, as stated earlier. Therefore, when the toner in the toner hopper 8 is introduced into the second space B via the first space A, the load acting on the developer in the space B does not vary despite any variation in the amount of toner in the hopper 8.

The flux density of the pole P4 is selected to be relatively low, as also stated earlier. This, coupled with gravity, noticeably reduces the occupancy of the developer in a region D (see FIG. 7) included in the second space B and remote from the sleeve 4. Therefore, even when the toner hopper 8 is full of toner, the developer is prevented from filling up the second space B and being compressed to an excessive degree. This insures the agitation of the developer in the space B and eliminates excessive torque.

Further, because the projection 7b is molded integrally with the penthouse 7a, the above advantage is achievable without increasing the number of parts. This reduces the cost of the developing device, compared to a device including a separate partitioning member.

As shown in FIG. 6, in this embodiment, the bottom wall of the first space A is implemented by a portion 2a of the casing 2 extending from the lower edge of the opening 8a to the vicinity of the surface of the sleeve 4. Further, the wall portion 2a is inclined downward from the opening 8a toward the sleeve 4. In addition, a distance Gt between the lower edge of the opening 8a and the surface of the sleeve 4 is selected to be 5 mm, to 10 mm which is greater than the gap Gs. Preferably, the doctor gap Gd, the gap Gs, and the distance Gt have a relation of Gd<Gs<Gt.

Assume that, when the developer being circulated in the first space A is mixed with the toner fed from the toner hopper 8, the sleeve 4 fails to firmly retain the developer thereon with the magnetic force and causes it to drop onto the wall portion 2a . Then, the inclined wall portion 2a prevents the developer from flowing into the hopper 8. Therefore, a sufficient amount of developer is maintained in the first and second spaces A and B over which the magnetic retaining force of the magnet roller 5 acts. This preserves the control level of the toner content of the developer over a long period of time. It is to be noted that the expected amount of developer can be maintained to a certain degree even if the wall portion 2a is horizontal.

In the illustrative embodiment, the first space A has a smaller volume than the second space B because the toner for development is charged in the second space B; it is not necessary for the carrier to exist in the space A as much as in the space B. Preferably, the volume of the space A should be as small as possible so long as it does not allow the weight acting on the toner of the hopper 8 to directly act on the developer present in the space B. This successfully saves the space of the developing device.

In this embodiment, as in the first embodiment, the first space A is positioned upstream of the second space B in the direction of conveyance. This enhances the efficient mixture and agitation of the toner and developer, compared to the device lacking the space A. As a result, the embodiment allows the charge of the toner due to friction to be sharply built up and eliminates background contamination and the fly-about of the toner.

The projection or partitioning member 7b separates the two spaces A and B and faces the sleeve 4 at a preselected distance, as stated earlier. Assume that when a start developer is initially set in the second space B, it is irregularly distributed in the axial direction of the sleeve 4. Then, when the sleeve 4 begins to convey the developer, the projection 7b levels the developer being transferred from the space A to the space B via the above gap. As a result, the developer is uniformly distributed in the chamber B in the axial direction of the sleeve 4.

The projection 7b protrudes from the surface of the toner storing member 7 facing the sleeve 4 toward the sleeve 4 and extends in the axial direction of the sleeve 4, as stated previously. Therefore, it is not necessary to extend the path along which the toner fed from the toner hopper 8 reaches the developer carried on the sleeve 4. The extended path would need extra toner feeding means and would increase the number of parts and the cost. This makes it needless to provide additional toner feeding means on the above path in addition to main toner feeding means disposed in a toner storing section. This kind of configuration is taught in previously mentioned Japanese Patent Laid-Open Publication No. 63-4287.

4th Embodiment

Figure 9:
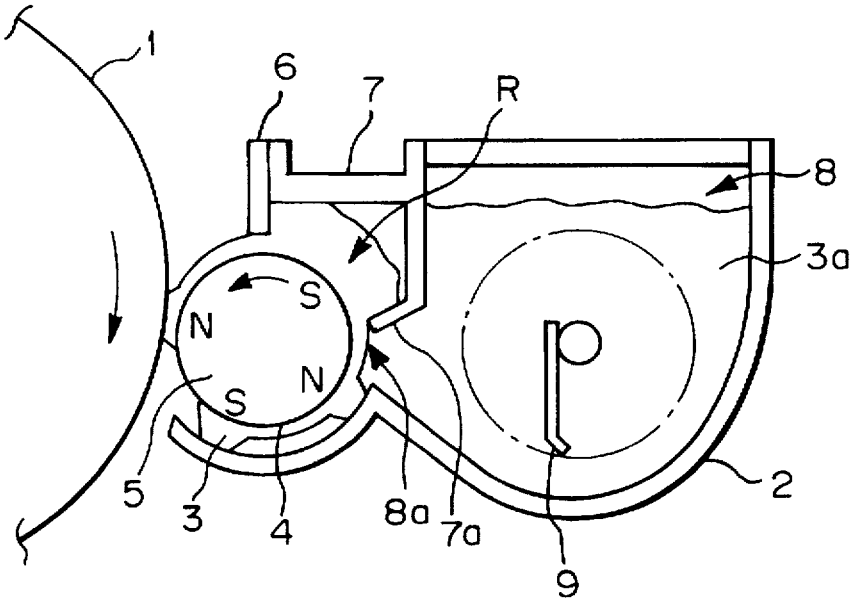
FIG. 9 is a front view showing a fourth embodiment of the present invention.

As shown in FIG. 9, a fourth embodiment of the present invention is also similar to the first embodiment except for the following. Briefly, this embodiment differs from the first embodiment as to the configuration of the penthouse 7*a* included in the developer storing member 7. As shown, the toner storing member or cover member 7 is so positioned as to form a developer storing space R between it and the sleeve 4 in the upper portion of the sleeve 4. Assume two poles of the magnet roller 5 adjoining each other at a position upstream of the doctor 6 in the direction of conveyance. Then, the penthouse 7*a* of the member 7 faces, but does not contact, a portion of the surface of the sleeve 4 intervening between the above two poles and where the magnetic force acting on the surface of the sleeve 4 in the direction normal thereto is minimum. The penthouse 7*a* faces the above portion of the sleeve 4 in the normal direction and regulates the replenishment of the toner 3*a* to the developer 3.

The illustrative embodiment is essentially similar to the previous embodiments as to operation. Specifically, the sleeve 4 rotating in the direction indicated by an arrow conveys the developer 3 deposited thereon. The doctor 6 regulates the amount in which the developer 3 being conveyed by the sleeve 4 is to pass through the gap between the doctor 6 and the sleeve 4. The developer 3 moved away from the doctor 6 is conveyed by the sleeve 4 to the developing position where the sleeve 4 faces the drum 1 also rotating in the direction indicated by an arrow. At the developing position, the toner in the developer is transferred from the sleeve 4 to a latent image electrostatically formed on the drum 1. As a result, the latent image is developed, i.e., turns out a toner image. The part of the developer 3 left on the sleeve 4 after the development is conveyed by the sleeve 4 toward the opening 8*a*. After the toner 3*a* has been replenished into this part of the developer 3 via the opening 8*a*, the developer 3 is returned to the space R. When the doctor 6 regulates the developer 3 now containing the replenished toner 3*a*, the pressure inside the developer 3 increases and charges the toner 3*a*. In this manner, the toner 3*a* of the developer 3 deposited on the sleeve 4 is charged by the internal pressure of the developer 3 in the portion of the space R adjoining the doctor 6. This eliminates the need for a paddle, screw or similar complicated agitating mechanism for charging or agitating the developer 3.

On the other hand, the developer 3 shaved off from the sleeve 4 by the doctor 6 flows down to the neighborhood of the opening 8*a* due to its own internal pressure and gravity. Then, the developer 3 is circulated toward the doctor 6 due to the movement of the developer 3 forming a layer on the sleeve 4.

As stated above, the volume of the developer 3 existing in the space R varies in accordance with the toner 3*a* being introduced into the space R, so that the toner content of the developer 3 is automatically controlled. Consequently, the toner content remains in a substantially constant range at all times. This eliminates the need for a toner content sensor, toner replenishing member or similar sophisticated toner content control mechanism.

Figure 10:
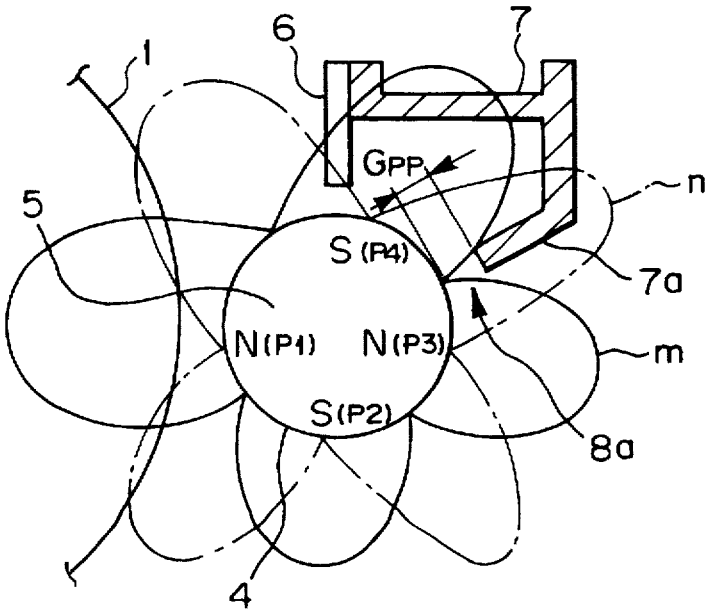
FIG. 10 is a front view showing a developing sleeve shown in FIG. 9 and its neighborhood.

FIG. 10 shows the sleeve 4 shown in FIG. 9 and its neighborhood. As shown, assume that the magnet roller 5 has poles P1, P2, P3 and P4 sequentially positioned toward the downstream side with respect to the point of the surface of the sleeve 4 facing the doctor or first regulating member 6. Also, assume that each pole or magnetic field generating means exerts a magnetic force mn in the direction normal to the surface of the sleeve 4, and that magnetic forces n act in the circumferential direction of the sleeve 4 parallel to the direction of conveyance. In this embodiment, the end portion of the penthouse 7*a* is bent inward toward the point of the sleeve 4 between the poles P3 and P4 and where the magnetic force m in the direction normal to the sleeve 4 is minimum. The bent end of the penthouse 7*a* is spaced from the sleeve 4 by a gap or predoctor gap Gpp. With this configuration, the penthouse 7*a* plays the role of a second developer regulating member.

Figure 11:
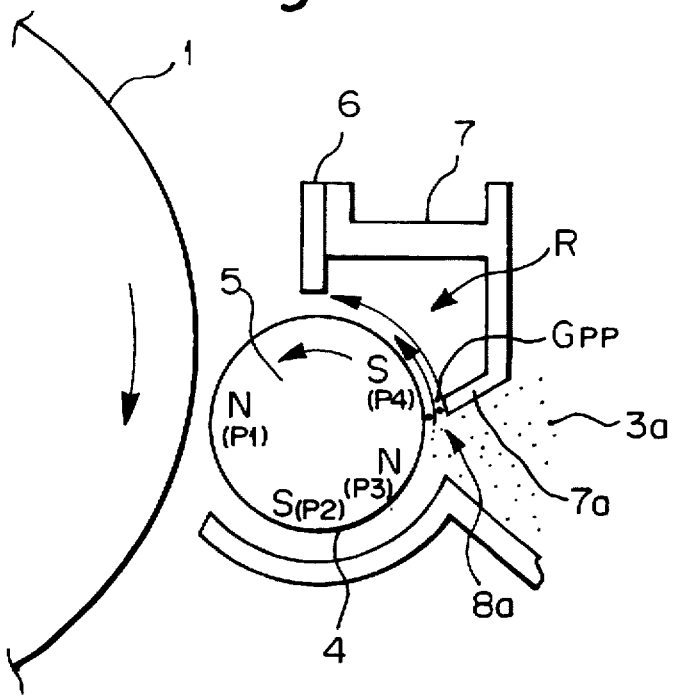
FIG. 11 shows how toner is introduced into a developer storing space included in the fourth embodiment.

FIG. 11 demonstrates how the toner 3*a* is introduced into the space R. As shown, the toner 3*a* is replenished via the opening 8*a* due to the movement of the developer 3 in the space R. At this instant, the developer 3 moving a great distance tends to take in a great amount of the toner 3*a*. However, the gap Gpp between the penthouse 7*a* and the sleeve 4 is so small, the amount of the toner 3*a* to be introduced into the space R is restricted.

Figure 12:
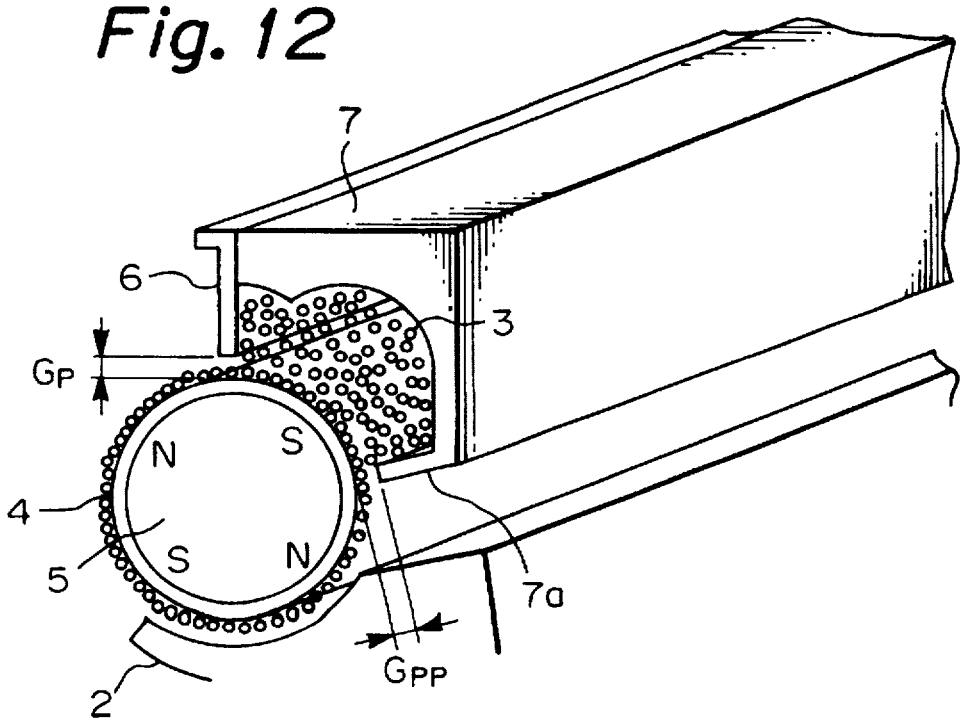
FIG. 12 is a perspective view showing a second developer regulating member also included in the fourth embodiment together with the sleeve.

FIG. 12 shows the penthouse 7*a* and sleeve 4 of this embodiment more specifically. When the doctor gap Gp and predoctor gap Gpp are respectively 0.3 mm and 1 mm, the toner 3*a* is desirably introduced into the space R, as determined by a series of experiments.

Assume that the magnetic force of any one of the poles of the magnet roller 5 is irregular in the axial direction of the roller 5. Then, the toner content of the developer is locally irregular in the space R in the direction perpendicular to the direction of conveyance, so that it is likely for the toner 3*a* to be replenished in great amounts at positions where the toner content is low. In the illustrative embodiment, the penthouse 7*a* reduces the opening 8*a* and regulates the replenishment of the toner 3*a* alone. This prevents the toner 3*a* from being locally replenished in an excessive amount, and thereby eliminates an irregular toner content distribution in the axial direction of the roller 5. In addition, because the penthouse 7*a* plays the role of the second developer regulating member, it is not necessary to use an extra regulating member which would increase the cost.

Figure 13:
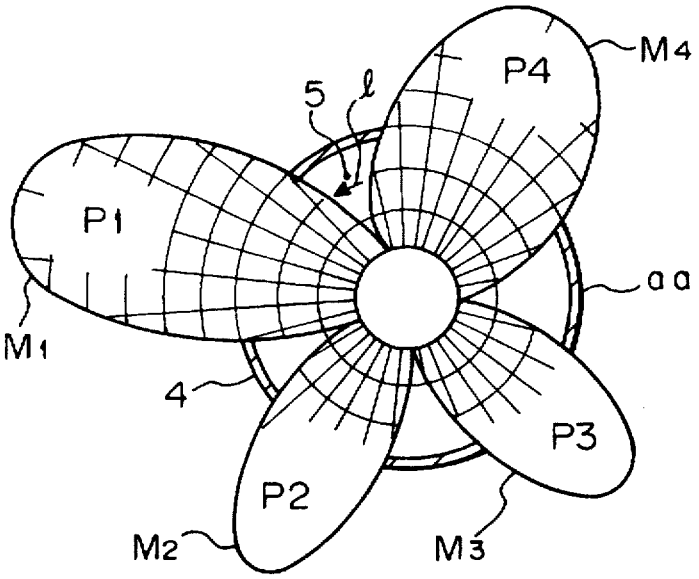
FIG. 13 shows a specific configuration of a developer carrier included in a developing device.

FIG. 13 also shows four poles P1–P4 sequentially arranged in the manner described with reference to FIG. 10.

The poles P1–P4 respective exert magnetic forces M1–M4 in the direction normal to the surface of the sleeve 4. As shown, in a portion aa between, e.g., the adjacent poles P3 and P4, the magnetic force acting in the above direction is zero, but the magnetic force in the circumferential direction of the sleeve 4 increases. At the position where the magnetic force in the normal direction is minimum, the absolute amount of the developer magnetically deposited on the sleeve 4 is small, and so is the toner content of the developer in the direction perpendicular to the direction of conveyance.

Figure 14:
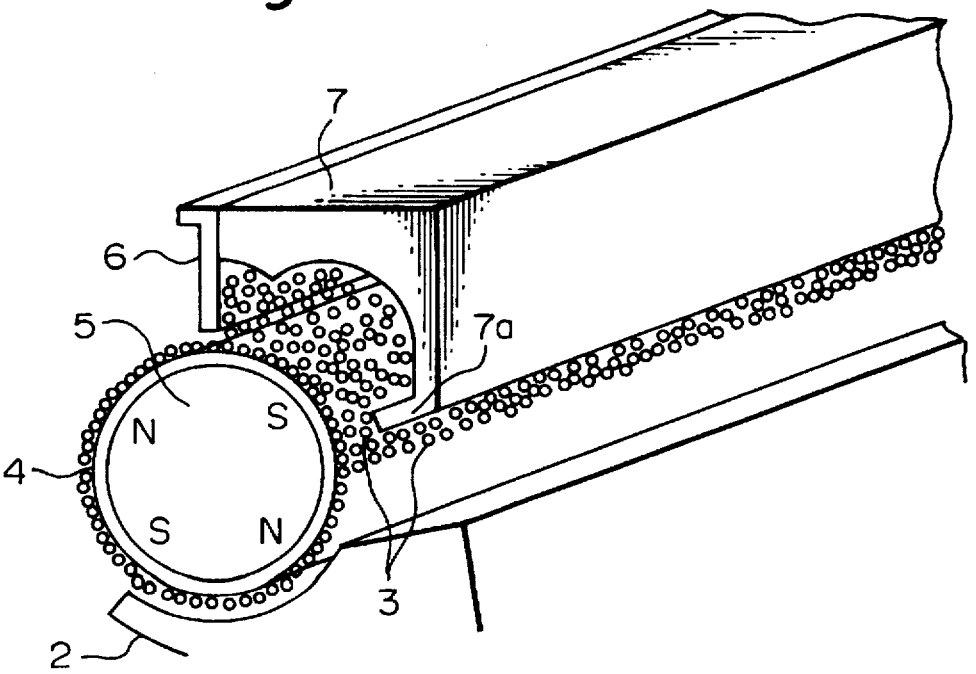
FIG. 14 is a view for comparing the fourth embodiment with a different developing device.

FIG. 14 shows another specific position of the penthouse 7*a* and useful for understanding the advantages of the illustrative embodiment. As shown, the penthouse 7*a* adjoins a position where the magnetic force m between the adjacent poles P3 and P4 and acting in the direction perpendicular to the sleeve 4 is not minimum, e.g., at a position deviated downward in the direction of conveyance from the position where the above force in is minimum. If the penthouse 7*a*, i.e., the predoctor gap Gpp, is located at such a deviated position, then the developer deposited on the sleeve 4 overflows the space R to the outside of the penthouse 7*a*. This obstructs the introduction of the toner 3*a* into the space R. The above embodiment eliminates such an occurrence and insures desirable replenishment of the toner 3*a*.

At the position on the sleeve 4 where the magnetic force m in the direction normal to the sleeve 4 is minimum, the magnetic force n in the direction tangential to the sleeve 4, i.e., parallel to the direction of conveyance is maximum, as stated earlier. In this condition, the force for conveying the developer is apt to be irregular in the axial direction of the sleeve 4 due to the irregular magnetic force distribution of the individual pole P3 or P4 in the same direction. In the illustrative embodiment, the penthouse 7*a* prevents the toner from being replenished in an excessive amount at the above position, and thereby eliminates an irregular toner distribution in the axial direction of the sleeve 4.

5th Embodiment

Figure 15:
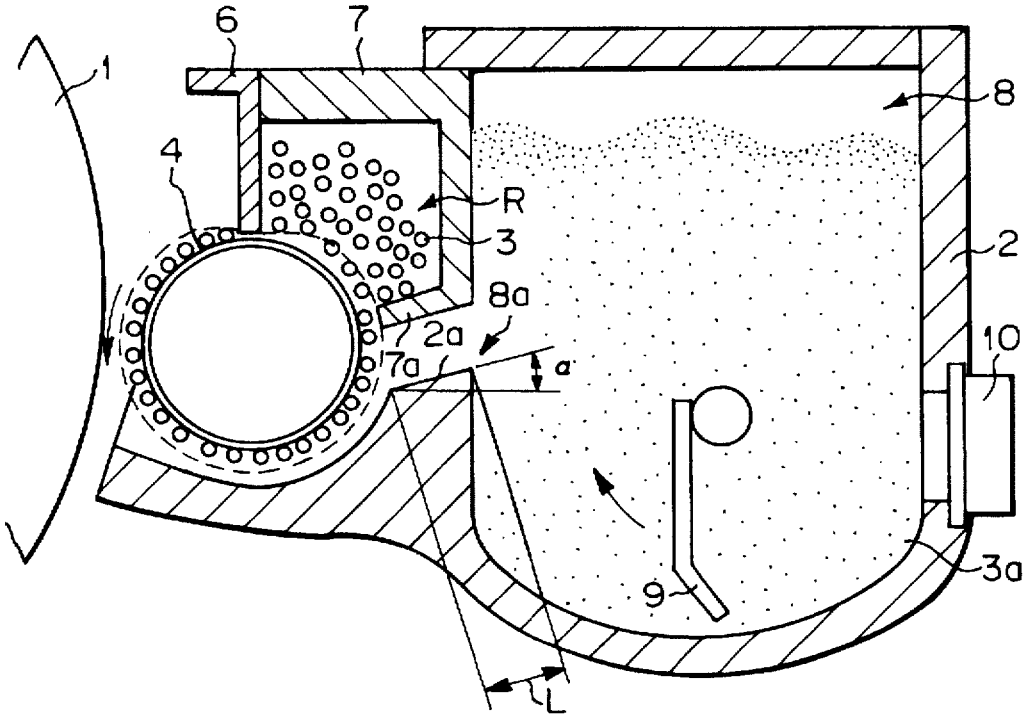
FIG. 15 is a front view showing a fifth embodiment of the present invention.

FIG. 15 shows a fifth embodiment of the present invention which is similar to the previous embodiments except for the following. This embodiment is characterized in that the gap between the end of the penthouse 7*a* and the sleeve 4 is so selected as to prevent, when the thickness of the developer layer formed on the sleeve 4 increases due to an increase in its toner content, the increment of the developer from passing through the above gap.

Figure 16:
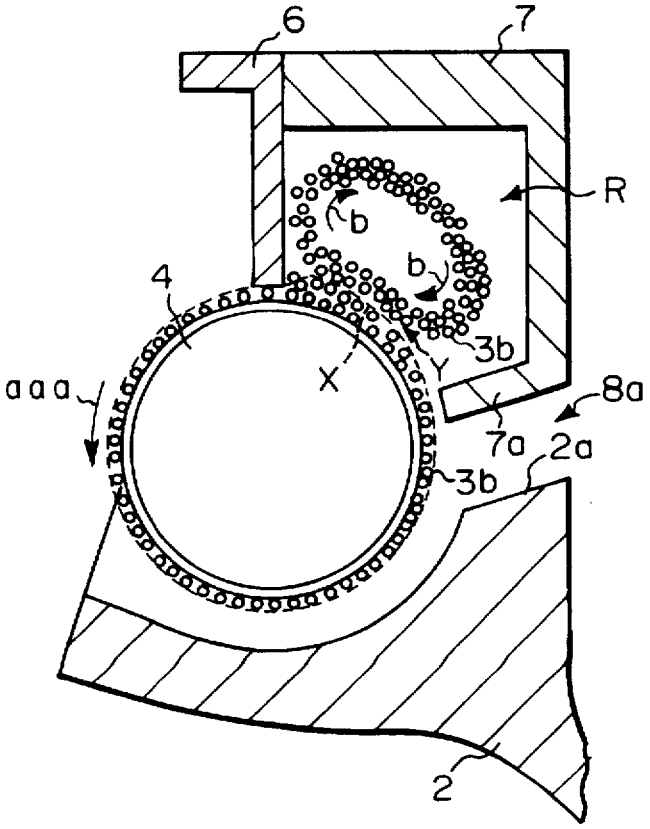
FIGS. 16–18 each shows the fifth embodiment in a particular condition with respect to the developer.
Figure 17:
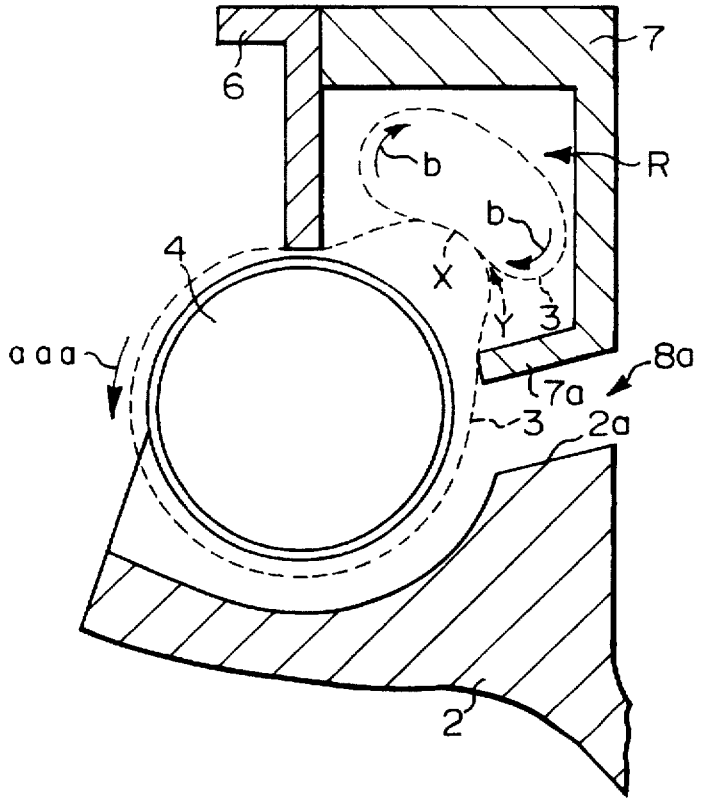

Reference will be made to FIGS. 16 and 17 for describing the behavior of the developer 3 to occur during development. Assume that a start developer consisting only of magnetic carrier particles 3*b* is initially set in the developing device shown in FIG. 15. Then, the carries particles 3*b* are partly magnetically deposited on the sleeve 4 and partly received in the space R. When the sleeve 4 is rotated in a direction aaa, the carrier the particles 3*b* received in the space R are circulated in a direction b at a speed of 1 mm/sec or above by the magnetic force acting thereon via the sleeve 4. As a result, an interface X occurs between the surface of the particles 3*b* deposited on the sleeve 4 and that of the particles 3*b* being circulated in the space R.

When the fresh toner 3*a* is set in the toner hopper 8, it is replenished to the carrier particles 3*b* deposited on the sleeve 4 via the opening 8*a*. The sleeve 4 therefore bears the developer 3, which contains toner mixed with the carrier particles of the developer.

In the space R, a force tending to stop the developer 3 being conveyed by the sleeve 4 acts due to the developer 3 present in the space R. When the toner particles 3*a* existing on the surface of the developer 3 deposited on the sleeve 4 are brought to the interface X, the friction acting between the developer 3 in the vicinity of the interface X decreases and reduces the force for conveying the developer 3.

Consequently, the amount of the developer 3 being conveyed in the vicinity of the interface X decreases.

The developer 3 being conveyed by the sleeve 4 and the developer being circulated in the space R meet each other at a point Y. The force tending to stop the developer 3 being conveyed by the sleeve 4, as stated above, does not act on the developer 3 at a position upstream of the point Y in the direction of rotation of the sleeve 4. Therefore, the particles of the developer 3 sequentially hit against each other because the developer brought to the point Y by the sleeve 4 and the developer being conveyed at the interface X are brought out of balance with respect to the amount of conveyance. As a result, as shown in FIG. 17, the point Y rises and causes the thickness of the developer 3 containing the interface X to increase. Also, the thickness of the developer 3 moved away from the doctor 6 sequentially increases. The increased developer 3 is shaved off by the end of the penthouse 7*a*, as shown in FIG. 18.

Figure 18:
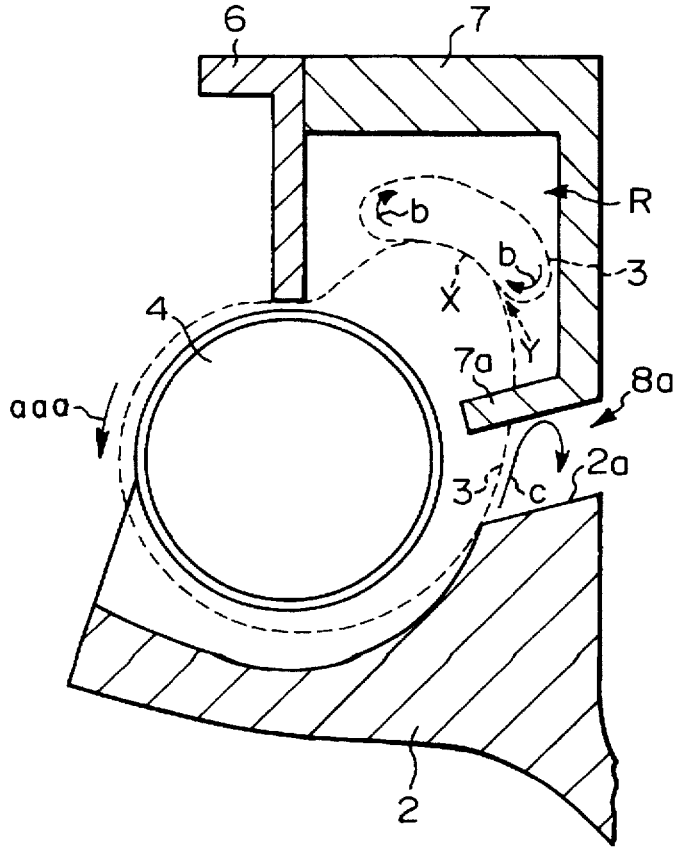

When the toner content of the developer 3 moved away from the doctor 6 reaches a preselected value, the increment of the developer shaved off by the penthouse 7*a* and forming a layer stops up the opening 8*a*, as shown in FIG. 18. As a result, the replenishment of the toner 3*a* ends. At this instant, the developer existing in the space R increases in volume due to the increase in toner content. Consequently, the space R is reduced to, in turn, lower the speed at which the developer 3 is circulated in the direction b.

In the layer of the developer 3 stopping up the opening 8*a*, the developer 3 shaved off by the end of the penthouse 7*a* moves at a speed of 1 mm/sec or above in a direction c, FIG. 18, until it has been received by the bottom wall portion 2*a*. As shown in FIG. 15, the wall portion 2*a* is inclined downward toward the sleeve 4 by a preselected angle α. This, coupled with the fact that the wall portion 2*a* has a preselected length L, prevents the developer 3 from dropping into the toner hopper 8. This maintains the amount of the developer 3 constant and allows the toner replenishment to be automatically controlled at all times.

It is to be noted that the automatic control described above is similarly applicable to the other embodiments shown and described. Specifically, the automatic control is achievable only if the gap between, e.g., the end of the projection 7*b* or that of the penthouse 7*a* and the sleeve 4 is adequately selected.

In the illustrative embodiment, the developer 3 removed from the sleeve 4 by the end of the penthouse 7*a* accumulates in the vicinity of the opening 8*a*. Therefore, the portion around the opening 8*a* plays the role of a developer storing space. In this sense, it may be said that the end of the penthouse 7*a* functions as a member partitioning the developer storing space adjoining the opening 8*a*, and the space R. The end of the penthouse 7*a* may play the role of a projection protruding from the developer storing member 7 toward the sleeve 4 and elongate in the direction perpendicular to the direction of conveyance, or the role of a member for regulating the powder pressure acting on the space R from the portion around the opening 8*a*, as desired. The end of the penthouse 7*a* should preferably face the point of the surface of the sleeve 4 intervening between two adjacent magnetic poles upstream of the doctor 6 and where the magnetic force in the direction normal to the sleeve 4 is minimum.

In summary, it will be seen that the present invention provides a developing device for an image forming apparatus and having various unprecedented advantages, as enumerated below.

(1) Toner contained in a developer existing on a developer carrier is charged by mixing and agitating the developer a plurality of times. This successfully reduces the probability that toner particles of lesser charge reach a developing position past a developer regulating member, compared to a configuration in which the mixture and agitation occurs only once. Further, when the toner content of the developer is irregular in the axial direction of the image carrier, the mixture and agitation of the developer including the oblique movement of the developer from high content portions to low content portions occurs a plurality of times. This makes uniform the amount of charge deposited on the toner and the toner content in the axial direction of the image carrier, compared to the above-mentioned conventional configuration. As a result, the device insures that images suffer from a minimum of background contamination and irregular density.

(2) Toner particles of lesser charge can be prevented from reaching the developing position only if a single projection is formed on the surface of a developer storing member facing the image carrier. This eliminates the need for a plurality of regulating members and thereby saves cost and space.

(3) The projection is formed in a region between the center of a pole facing the developer storing space and that of an adjacent pole upstream of the above pole in a direction of conveyance. In the above region, a magnetic force attracting the developer deposited on the developer carrier toward the developer carrier is weak. Therefore, the projection obstructs the developer more easily than when it adjoins the above magnetic pole. This enhances the circulation of the developer for agitation and mixture.

(4) The toner is replenished to the developer via an opening formed in the toner storing section. The developer passed through a gap between the end of the toner storing member adjoining the above opening and the developer carrier is caused to pass through a gap between the projection and the developer carrier and which is smaller than the above gap. The projection therefore surely blocks a part of the developer replenished via the opening. This also enhances the circulation of the developer for agitation and mixture.

(5) A plurality of projections are formed in the direction of conveyance. At least one of the projections is divided in the direction perpendicular to the direction of conveyance, so that voids are formed for allowing the developer to pass therethrough. The developer blocked by the divided portions of the projection move in the axial direction of the developer carrier and then pass through the voids. This enhances the developer agitating ability in the axial direction of the developer carrier. Further, the most downstream one of the projections is spaced from the image carrier by a substantially constant distance in the direction perpendicular to the direction of conveyance. Therefore, the developer desirably mixed and agitated in the above direction is allowed to pass the downstream projection in a uniform amount in the same direction.

(6) A toner bearing member sustains the toner existing above a toner replenishing path adjoining the opening. The toner bearing member therefore causes the weight of the toner to act little on the developer existing in the developer storing space adjoining the opening. Consequently, the mixture and agitation in the developer storing space is stabilized without regard to the amount of the toner remaining in the toner storing section.

(7) The level at which the toner bearing member bears the weight of the tone is selected to be lower than the toner end sensing level of toner end sensing means. This insures the stable mixture and agitation of the developer in the toner storing space until the toner storing section reaches a toner end condition.

(8) Even when the weight of the toner present in the toner storing section acts on the developer existing in a first space, it does not directly act on the developer existing in a second space. The second space therefore includes a portion in which the developer is not packed. It follows that even when the weight of the toner is heavy, e.g., when a great amount of toner exists in the toner storing section, the developer in the second space is not compressed to a critical degree. This insures the fluidity of the developer in the second space. As a result, the agitation of the developer in the second space is promoted due to the conveyance of the toner without regard to the weight of the toner present in the toner storing section. At the same time, there can be eliminated excessive torque ascribable to the compression of the developer in the second space.

(9) The partition member is molded integrally with the developer storing member. This successfully reduces the number of parts and cost.

(10) A part of the developer introduced into the first space is blocked by the partitioning member and circulated in the first space. Further, a bottom wall extending from the lower edge of the opening toward the developer carrier either horizontally or with inclination prevents the above developer from flowing into the toner storing section. This guarantees a necessary amount of magnetic particles in the first and second spaces on which the magnetic retaining force of the magnetic field generating means acts. Therefore, the toner density control level can be maintained over a long period of time.

(11) The first space is smaller in volume than the second space within a range which prevents the weight of the toner in the toner storing section from directly acting on the second space. This saves the space taken up by the device.

(12) A second developer regulating member is located at a position where the magnetic force in the direction normal to the developer carrier is minimum, as measured between two magnetic poles upstream of the first developer regulating member in the direction of conveyance. The toner is introduced into the developer storing space while the second developer regulating member limits the maximum amount of toner to be replenished form the upstream side to the downstream side. As a result, the toner is prevented from being replenished in an excessive amount at portions where the developer density is comparatively low. This stabilizes the amount of toner replenishment in the direction perpendicular to the direction of conveyance and reduces irregular toner density in the same direction. This can be done only if the second regulating member is provided in the device.

(13) The second regulating member is formed integrally with a cover member. This reduces the number of parts and realizes a miniature inexpensive configuration.

Various modifications will become possible for those skilled in the art after receiving the teachings of the present disclosure without departing from the scope thereof.

What is claimed is:

1. A developing device comprising:

a developer carrier for conveying a developer deposited thereon and containing toner and magnetic particles;

magnetic field generating means disposed in said developer carrier, for generating a magnetic field for depositing the developer on said developer carrier;

a developer regulating member for regulating an amount of the developer deposited on said developer carrier;

a developer storing member forming a developer storing space adjoining said developer regulating member from an upstream side with respect to a direction of conveyance in which said developer carrier conveys the developer;

a toner storing section adjoining said developer storing space from an upstream side in the direction of conveyance, and having an opening for toner replenishment facing said developer carrier, wherein fresh toner is replenished from said toner storing section to the developer via said opening due to movement of the developer; and first and second projections protruding from a surface of said developer storing member facing said developer carrier toward said developer carrier, wherein said first projection extends in a direction perpendicular to the direction of conveyance, and wherein said second projection protrudes from an inner periphery of the developer storing member.

2. A device as claimed in claim 1, wherein said first projection intervenes between a center of a magnetic pole present at a portion of said magnetic field generating means facing said developer storing space and a center of a magnetic pole adjacent to said center of said magnetic field at an upstream side with respect to the direction of conveyance.

3. A device as claimed in claim 1, wherein a gap between said first projection and said developer carrier is smaller than a gap between an end of said developer storing member adjoining said opening and said developer carrier.

4. A device as claimed in claim 1, wherein said first projection comprises a plurality of projections sequentially formed in the direction of conveyance.

5. A device as claimed in claim 1, wherein a gap between said first projection and said developer carrier is selected such that when a thickness of the developer deposited on said developer carrier increases due to an increase in a toner content of the developer, an increment of the developer is blocked by said first projection.

6. A device as claimed in claim 1, wherein the developer existing in said developer storing space moves within said developer storing space without regard to a change in the toner content of the developer deposited on said developer carrier.

7. A developing device comprising:

a developer carrier for conveying a developer deposited thereon and containing toner and magnetic particles;

magnetic field generating means disposed in said developer carrier, for generating a magnetic field for depositing the developer on said developer carrier;

a developer regulating member for regulating an amount of the developer deposited on said developer carrier;

a developer storing member forming a developer storing space adjoining said developer regulating member from an upstream side with respect to a direction of conveyance in which said developer carrier conveys the developer;

a toner storing section adjoining said developer storing space from an upstream side in the direction of conveyance, and having an opening for toner replenishment facing said developer carrier, wherein fresh toner is replenished from said toner storing section to the developer via said opening due to movement of the developer; and a toner bearing member disposed in said toner storing section in the vicinity of said opening, for bearing a weight of the toner at a level lower than a toner level in said toner storing section.

8. A device as claimed in claim 7, further comprising toner end sensing means for sensing a toner end condition occurred in said toner storing section.

9. A device as claimed in claim 8, wherein the level at which said toner bearing member bears the weight of the toner is lower than a level at which said toner end sensing means senses the toner end condition.

10. A device as claimed in claim 7, wherein said developer storing space includes a second developer regulating member positioned upstream of said developer regulating member in the direction of conveyance, and wherein a gap between said second developer regulating member and said developer carrier is selected such that when a thickness of the developer deposited on said developer carrier increases due to an increase in a toner content of the developer, said second developer regulating means blocks an increment of the developer.

11. A device as claimed in claim 7, wherein the developer existing in said developer storing space moves within said developer storing space without regard to a change in the toner content of the developer deposited on said developer carrier.

12. A developing device comprising:

a developer carrier for conveying a developer deposited thereon and containing toner and magnetic particles;

magnetic field generating means disposed in said developer carrier, for generating a magnetic field for depositing the developer on said developer carrier;

a developer regulating member for regulating an amount of the developer deposited on said developer carrier;

a developer storing member forming a developer storing space adjoining said developer regulating member from an upstream side with respect to a direction of conveyance in which said developer carrier conveys the developer; and a toner storing section adjoining said developer storing space from an upstream side in the direction of conveyance, and having an opening for toner replenishment facing said developer carrier, wherein fresh toner is replenished from said toner storing section to the developer via said opening due to movement of the developer;

said developer storing space including first and second partition members separating said developer storing space into a first space facing said opening and located at an upstream side with respect to the direction of conveyance, a second space located at a downstream side of the first space with respect to the direction of conveyance, and a third space located at a downstream side of the second space with respect to the direction of conveyance, wherein said first partition member separates said first space and said second space and said second partition member separates said second space and said third space, and wherein said first and said second partition members protrude from a surface of a wall of said developer storing member facing said developer carrier toward said developer carrier and extend in a direction perpendicular to the direction of conveyance, and wherein said first partition member faces a surface of said developer carrier at an end of said first partition member at a preselected distance, regulating a powder pressure of the developer acting on said second space from said first space.

13. A device as claimed in claim 12, wherein said first partition member is molded integrally with said developer storing member.

14. A device as claimed in claim 12, wherein a bottom wall of said developer storing space forms a lower edge of said opening with an end portion thereof adjoining said toner storing section, wherein a distance Gt between said lower edge of said opening and the surface of said developer carrier is greater than the distance between said surface of said developer carrier and said end of said first partition member, and wherein said bottom wall of said developer storing space is horizontal or inclined downward from said lower edge of said opening toward said developer carrier.

15. A device as claimed in claim 12, wherein said first space is smaller in volume than said second space.

16. A device as claimed in claim 12, wherein the distance between said first partition member and said developer carrier is selected such that when a thickness of a layer of the developer increases due to an increase in a toner content of the developer deposited on said developer carrier, said first partition member blocks an increment of the developer.

17. A device as claimed in claim 12, wherein the developer existing in said developer storing space moves within said developer storing space without regard to a change in the toner content of the developer deposited on said developer carrier.

18. A developing device comprising:

a developer carrier for conveying a developer deposited thereon and containing toner and magnetic particles;

magnetic field generating means disposed in said developer carrier, for generating a magnetic field for depositing the developer on said developer carrier;

a first developer regulating member for regulating an amount of the developer deposited on said developer carrier;

a developer storing space surrounded by a cover member and a surface of said developer carrier, for allowing the developer blocked by said first developer regulating member to stay in said developer storing space;

a toner storing section adjoining said developer storing space from an upstream side in the direction of conveyance, and having an opening for toner replenishment facing said developer carrier, wherein fresh toner is replenished from said toner storing section to the developer via said opening due to movement of the developer;

a second developer regulating member facing, in a direction normal to said surface of said developer carrier, a point of said surface of said developer carrier between a center of a magnetic pole present at a portion of said magnetic field generating means facing said developer storing space and a center of a magnetic pole adjacent to said center of said magnetic field at an upstream side with respect to the direction of conveyance and where a magnetic force in the direction normal to said surface of said developer carrier is minimum, for thereby regulating replenishment of the toner; and a third developer regulating member facing said developer carrier and located downstream of said second regulating member and upstream of said first regulating member in the direction of conveyance.

19. A device as claimed in claim 18, wherein said second developer regulating member is molded integrally with said cover member.

20. A device as claimed in claim 18, wherein said second developer regulating member and said developer carrier are spaced by such a distance that when a thickness of a layer of the developer increases due to an increase in a toner content of the developer deposited on said developer carrier, said second developer regulating member blocks an increment of the developer.

21. A device as claimed in claim 18, wherein the developer existing in said developer storing space moves within said developer storing space without regard to a change in the toner content of the developer deposited on said developer carrier.

22. A developing device comprising:

a developer carrier for conveying a developer deposited thereon and containing toner and magnetic particles;

magnetic field generating means disposed in said developer carrier, for generating a magnetic field for depositing the developer on said developer carrier;

a developer regulating member for regulating an amount of the developer deposited on said developer carrier;

a developer storing member forming a developer storing space adjoining said developer regulating member from an upstream side with respect to a direction of conveyance in which said developer carrier conveys the developer;

a toner storing section adjoining said developer storing space from an upstream side in the direction of conveyance, and having an opening for toner replenishment facing said developer carrier, wherein fresh toner is replenished from said toner storing section to the developer via said opening due to movement of the developer; and a plurality of projections protruding from a surface of said developer storing member facing said developer carrier toward said developer carrier, and extending in a direction perpendicular to the direction of conveyance, wherein one of said plurality of projections located at a most downstream side in the direction of conveyance is spaced from a surface of said developer carrier by a substantially constant distance in a direction perpendicular to the direction of conveyance, and wherein at least one of the other projections is divided in the direction of perpendicular to the direction of conveyance.

23. A device as claimed in claim 22, wherein gaps between said plurality of projections and said developer carrier are smaller than a gap between an end of said developer storing member adjoining said opening and said developer carrier.

24. A device as claimed in claim 22, wherein gaps between said plurality of projections and said developer carrier are selected such that when a thickness of the developer deposited on said developer carrier increases due to an increase in a toner content of the developer, an increment of the developer is blocked by said projection.

25. A device as claimed in claim 22, wherein the developer existing in said developer storing space moves within said developer storing space without regard to a change in a toner content of the developer deposited on said developer carrier.

* * * * *